US006715420B2

(12) United States Patent
Blake et al.

(10) Patent No.: US 6,715,420 B2
(45) Date of Patent: Apr. 6, 2004

(54) PRINTING PLATE WITH DYED AND ANODIZED SURFACE

(75) Inventors: Sallie L. Blake, Long Grove, IA (US); Albert L. Askin, Lower Burrell, PA (US); Robert E. Bombalski, New Kensington, PA (US); Daniel L. Serafin, Wexford, PA (US)

(73) Assignee: Alcoa Inc., Pittsburgh, PA (US)

( * ) Notice: Subject to any disclaimer, the term of this patent is extended or adjusted under 35 U.S.C. 154(b) by 9 days.

(21) Appl. No.: 10/186,795

(22) Filed: Jul. 1, 2002

(65) Prior Publication Data

US 2003/0000409 A1 Jan. 2, 2003

Related U.S. Application Data

(60) Provisional application No. 60/302,396, filed on Jul. 2, 2001.

(51) Int. Cl.[7] ..... B41N 1/08

(52) U.S. Cl. ..... 101/456; 101/458; 101/467; 430/302

(58) Field of Search ..... 101/456, 458, 101/459, 467; 430/302

(56) References Cited

U.S. PATENT DOCUMENTS

| | | | | | |
|---|---|---|---|---|---|
| 3,511,661 | A | * | 5/1970 | Rauner et al. | 430/278.1 |
| 4,081,572 | A | * | 3/1978 | Pacansky | 430/300 |
| 4,596,189 | A | * | 6/1986 | Halpern et al. | 101/458 |
| 5,353,705 | A | | 10/1994 | Lewis et al. | 101/453 |
| 5,677,101 | A | | 10/1997 | Noguchi et al. | 430/166 |
| 5,829,353 | A | | 11/1998 | Ellis | 101/460 |
| 5,950,542 | A | * | 9/1999 | Harris et al. | 101/457 |
| 5,962,188 | A | * | 10/1999 | DeBoer et al. | 101/458 |
| 5,996,496 | A | | 12/1999 | Lewis et al. | 101/462 |
| 5,996,498 | A | | 12/1999 | Lewis | 101/467 |
| 6,014,929 | A | * | 1/2000 | Teng | 101/456 |
| 6,022,668 | A | * | 2/2000 | Burberry et al. | 430/302 |
| 6,090,524 | A | | 7/2000 | Deboer et al. | 430/272.1 |
| 6,250,225 | B1 | * | 6/2001 | Rompuy et al. | 101/467 |
| 6,352,028 | B1 | * | 3/2002 | Ellis | 101/458 |
| 6,374,737 | B1 | * | 4/2002 | Bennett et al. | 101/457 |
| 6,387,595 | B1 | * | 5/2002 | Teng | 430/302 |
| 6,495,310 | B2 | * | 12/2002 | Teng | 430/303 |

FOREIGN PATENT DOCUMENTS

| | | | |
|---|---|---|---|
| EP | 428071 | 5/1991 | B41N/3/03 |
| EP | 678380 | 10/1995 | B41C/1/10 |
| EP | 730202 | 9/1996 | G03F/7/07 |
| EP | 1033261 | 9/2000 | B41N/3/03 |
| FR | 1578354 | 8/1969 | |
| WO | 0108885 | 2/2001 | B41C/1/10 |

* cited by examiner

*Primary Examiner*—Charles H. Nolan, Jr.
*Assistant Examiner*—Jill E Culler
(74) *Attorney, Agent, or Firm*—Glenn E. Klepac; Julie W. Meder

(57) ABSTRACT

A printing plate for computer-to plate lithography having a metal substrate with an anodized surface portion. The anodized surface portion has a porous texture in which a radiation-absorbing composition, preferably a black dye, is deposited. The surface portion with the radiation-absorbing composition is covered with a hydrophilic polymer or a sealant both. Upon exposure to laser radiation, the underlying oleophilic anodized surface portion containing the radiation-absorbing composition is revealed. Alternatively, laser radiation of the polymer composition may cause the affinity of the polymer for water and ink to change so that an irradiated portion of the polymer becomes oleophilic while the non-irradiated portion remains hydrophilic.

24 Claims, 3 Drawing Sheets

PRINTING PLATE WITH DYED AND ANODIZED SURFACE

RELATED APPLICATION

This application claims the benefit of U.S. Provisional Patent Application No. 60/302,396 filed Jul. 2, 2001 entitled "Printing Plate With Dyed And Anodized Surface."

FIELD OF THE INVENTION

The present invention relates to printing plates suitable for imaging by digitally controlled laser radiation. More particularly, the invention relates to a printing plate having a dyed, anodized metal substrate.

BACKGROUND OF THE INVENTION

Printing plates suitable for imaging by digitally controlled laser radiation include a plurality of imaging layers and intermediate layers coated thereon. Laser radiation suitable for imaging printing plates preferably has a wavelength in the visible or near-infrared region, between about 400 and 1500 nm, typically at about 830 nm. Solid state laser sources (commonly termed "semiconductor lasers") are economical and convenient sources that may be used with a variety of imaging devices. Other laser sources such as $CO_2$ lasers and lasers emitting light in the visible wavelengths are also useful.

Laser output can be provided directly to the plate surface via lenses or other beam-guiding components, or transmitted to the surface of a blank printing plate from a remotely sited laser through a fiber-optic cable. Some prior art patents disclosing printing plates suitable for imaging by laser ablation are Lewis et al. U.S. Pat. Nos. 5,339,737; 5,996,496 and 5,996,498. These prior art printing plates require multiple layers of differing materials and often are costly to produce. Accordingly, a need remains for a simple and inexpensive radiation treatable printing plate.

SUMMARY OF THE INVENTION

This need is met by the printing plate of the present invention having a metal substrate with an anodized surface portion. The surface portion defines a plurality of pores containing a radiation-absorbing composition. A coating composition covers the surface portion along with the radiation-absorbing composition. The metal may be an aluminum alloy that may be roll textured to have a roughness of about 5 to about 45 microinches.

The radiation-absorbing composition may be oleophilic while the coating composition is hydrophilic such as an acrylic polymer. A suitable acrylic polymer is a copolymer of vinyl phosphonic acid and acrylic acid cured under conditions such that said copolymer is hydrophilic or oleophilic. If the radiation-absorbing composition is hydrophilic, the coating composition may be oleophilic. Other suitable coating compositions include nickel acetate, silicate, and polyvinylphosphonic acid.

The coating composition may be ablated by radiation directed onto the coating composition overlying the radiation-absorbing composition. Alternatively, a first affinity for ink by the coating composition may change to a second affinity for ink when the coating composition overlying the radiation-absorbing composition is subjected to radiation without ablation of the coating composition.

The printing plate may further include a sealant composition disposed between the radiation-absorbing composition and the coating composition. In that case, both of the sealant composition and the coating composition overlying the radiation-absorbing composition are ablatable by radiation directed thereto. Alternatively, the sealant and coating compositions may not be ablated. Instead, a first affinity for ink by the coating composition may change to a second affinity for ink when the coating composition overlying the radiation-absorbing composition is subjected to radiation.

The present invention also includes a method of imaging having the steps of (i) providing a printing plate having a metal substrate with an anodized surface portion defining a plurality of pores, a radiation-absorbing composition received in the pores, and a coating composition covering the surface portion with the radiation-absorbing composition; and (ii) exposing the printing plate to a pattern of imaging radiation such that a first portion of the printing plate has an affinity for a printing fluid and a second portion of the printing plate has a different affinity for the printing fluid. The exposing step may include ablating the coating composition in the location of the pattern of imaging radiation to reveal the anodized surface portion as the first portion of the printing plate, the coating composition not exposed to the radiation being the second portion of the printing plate. Alternatively, the exposing step may include changing the affinity of the coating composition for a printing fluid in the location of the pattern of imaging radiation to the different affinity.

DETAILED DESCRIPTION OF THE PREFERRED EMBODIMENT

For purposes of the description hereinafter, it is to be understood that the invention may assume various alternative variations and step sequences, except where expressly specified to the contrary. It is also to be understood that the specific products and processes illustrated in the attached drawings, and described in the following specification, are simply exemplary embodiments of the invention. Hence, specific dimensions and other physical characteristics related to the embodiments disclosed herein are not to be considered as limiting.

Figure 1:
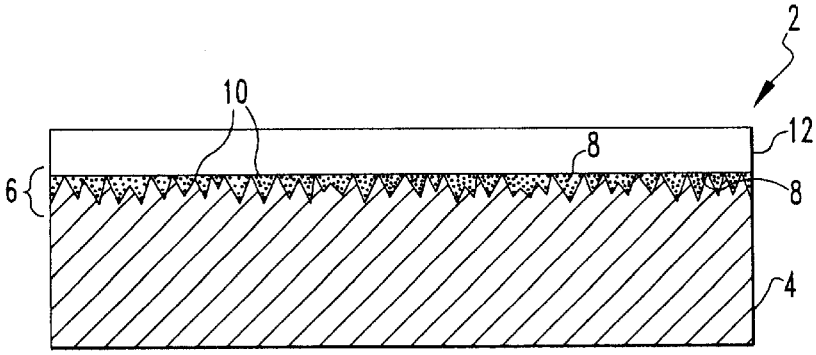
FIG. 1 is a cross-sectional view of a printing plate made in accordance with the present invention having a coating composition.

As shown in FIG. 1, the present invention includes a printing plate 2 having a metal substrate 4 with an anodized principal surface portion 6 defining a plurality of pores or wells 8 therein. A radiation-absorbing composition 10, which absorbs radiation, is deposited in the pores 8. A layer 12 of a polymeric coating composition covers the anodized surface portion 6, including the radiation-absorbing composition.

The substrate 4 may be an anodizable metal such as an alloy of aluminum, titanium or magnesium. Suitable aluminum alloys include alloys of the AA 1000, 3000, and 5000 series. The substrate 4 preferably has a thickness of about 1–30 mils, preferably about 5–20 mils, and more preferably about 8–20 mils.

Preferably, the substrate 4 is roll textured using one or more rolls treated with a texturing means to provide an extended surface area to the substrate 4. The texture of the treated roll has a substantially uniform topography which imparts a substantially uniform topography in the rolling and cross-rolling directions of the substrate 4 and having an Ra value of about 5 to about 45 microinches wherein the Ra ratio of rolling to cross-rolling is about 0.8 to 1.2, as described in U.S. Pat. No. 6,290,632 entitled "Ultrafine Matte Finish Roll for Treatment for Sheet Products and Method of Production", incorporated herein by reference. The texturing means may be electron discharge texturing, laser texturing, electron beam, shot peening, mechanical texturing, and chemical etching and some combination thereof, preferably electron discharge texturing.

The principal surface portion 6 may be cleaned to remove surface contaminants such as lubricant residues. Suitable chemical surface cleaners include alkaline and acid aqueous solutions. Plasma radiation, corona discharge and laser radiation may also be used.

A conventional anodization process may be used to create the pores 8. For an aluminum alloy substrate, the substrate 4 is placed in a conventional anodizing bath containing a conductive electrolyte such as sulfuric acid, phosphoric acid, oxalic acid, chromic acid or salicylic acid to produce a layer of porous alumina. The dimensions of the pores 8 may be controlled by the concentration of the electrolyte in the bath and the bath temperature. A suitable concentration of the electrolyte is about 10–30 wt. %. A preferred electrolyte bath contains about 20 wt. % sulfuric acid. When the substrate 4 is an aluminum alloy, anodization creates a layer of alumina on the surface portion, which is about 0.05 to about 0.7 mil thick.

The radiation-absorbing composition 10 is applied to the surface portion 6 by spraying, brushing, dipping or the like and is absorbed into the pores 8 and become trapped therein. The radiation-absorbing composition 10 maybe an oleophilic material, which absorbs infrared radiation such as a black dye. A suitable dye is an azine compound or an azide compound or any other dye that absorbs light having a wavelength in the range of about 500 to about 1100 nanometers. One such dye is Nigrosine Base BA available from Bayer Corporation of Pittsburgh, Pa. The anodized metal generally is hydrophilic. However, by including an oleophilic radiation-absorbing composition 10 in the pores 8, the surface portion 6 may become oleophilic depending on the amount and composition of the radiation-absorbing composition 10 deposited in the pores 8. Alternatively, the radiation-absorbing composition 10 may be hydrophilic and the surface portion 6 remains hydrophilic following deposition of the hydrophilic radiation-absorbing composition 10 in the pores 8.

The polymer coating composition 12 preferably includes an acrylic polymer, more preferably a copolymer of an organophosphorus compound. As used herein, the term "organophosphorus compound" includes organophosphoric acids, organophosphonic acids, organophosphinic acids, as well as various salts, esters, partial salts, and partial esters thereof. The organophosphorus compound may be copolymerized with acrylic acid or methacrylic acid. Copolymers of vinyl phosphonic acid are particularly preferred, especially copolymers containing about 5–50 mole % vinyl phosphonic acid and about 50–95 mole % acrylic acid and having a molecular weight of about 20,000–100,000. Copolymers containing about 70 mole % acrylic acid groups and about 30 mole % vinyl phosphonic acid groups are particularly preferred. The acrylic polymer may be applied in batch processing of sheet or in coil processing by conventional coating processes including roll coating, powder coating, spray coating, vacuum coating, emulsion coating or immersion coating. Preferably, the acrylic polymer is applied by roll coating, typically to a thickness of about 0.001–1.0 mil, preferably about 0.01–0.03 mil. Acrylic polymers including copolymers of vinyl phosphonic acid and acrylic acid are hydrophilic when cured at about 420° F. for about two minutes. These same acrylic polymers may be made oleophilic when cured at about 500° F. for about two minutes.

Figure 2:
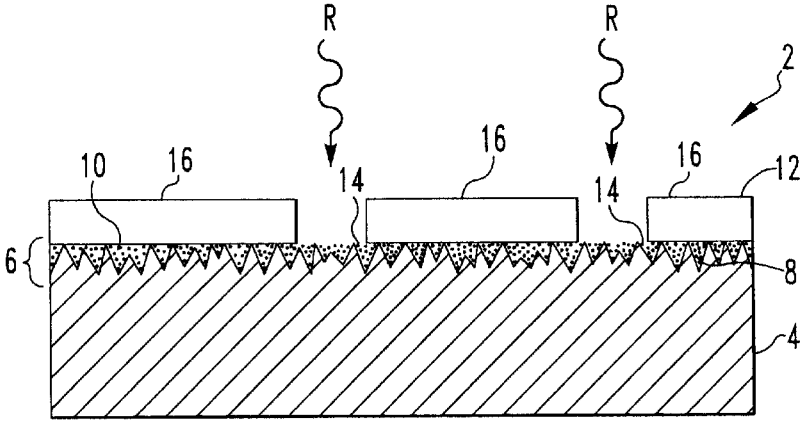
FIG. 2 is a cross-sectional view of the printing plate shown in FIG. 1 following radiation ablation of the coating composition.

In use, the printing plate 2 is imaged with a laser or the like. As shown in FIG. 2, a pattern of radiation R from a laser ablates the coating composition 12 in the regions 14 of the printing plate 2 in which ink is to be received. Ablation of the coating composition 12 exposes regions 14 of the substrate leaving unablated regions 16. The ablated regions 14 are oleophilic while the unablated regions 16 remain hydrophilic. Ink of a printing liquid containing water or a fountain solution will adhere to the ablated regions 14 while the unablated regions 16 will be covered with water or a fountain solution.

The regions 14 and 16 may have a reverse affinity for ink and water. In that case, a hydrophilic material is used as the radiation-absorbing composition 10 (e.g. Nigrosine WLF from Bayer) and the polymer coating composition 12 is oleophilic. A suitable oleophilic polymer is a copolymer of vinyl phosphonic acid and acrylic acid cured at about 500° F. for about two minutes. Following ablative imaging with a laser, the ablated regions 14 are hydrophilic and the unablated regions 16 are oleophilic.

Figure 3:
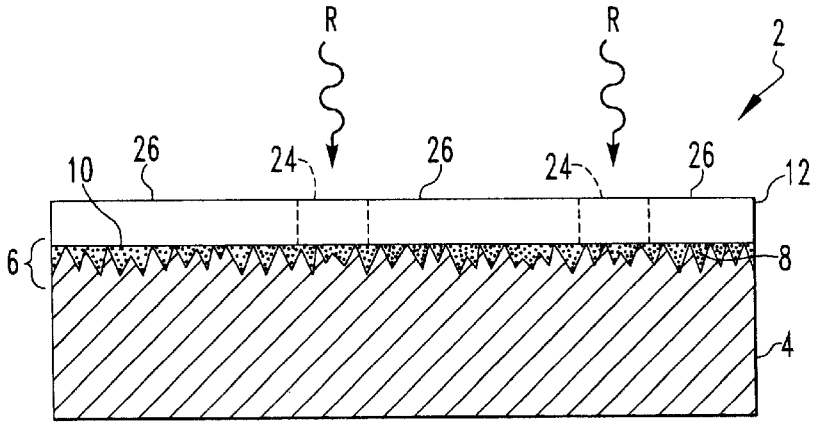
FIG. 3 is a cross-sectional view of an alternative view of the printing plate of FIG. 1 following radiation treatment of the coating composition to change the affinity of the coating composition for a printing liquid.

In another aspect of the invention shown in FIG. 3, the coating composition 12 includes a hydrophilic polymer, e.g. a copolymer of vinyl phosphonic acid and acrylic acid cured at about 420° F. for about two minutes. A pattern of imaging radiation R from a laser or the like causes regions 24 of the coating composition 12 to become oleophilic (without ablating the coating composition 12) while unexposed regions 26 remain hydrophilic. Ink of a printing liquid containing water or a fountain solution will adhere to the regions 24 while the regions 26 will be covered with water or a fountain solution. It is believed that when radiation is absorbed by the radiation-absorbing composition 10, heat is generated which is conducted to the regions 24 of the coating composition 12. Heating of the regions 24 is believed to change the surface chemistry of the polymer such that the affinity of the regions 24 for a printing liquid is altered.

Figure 4:
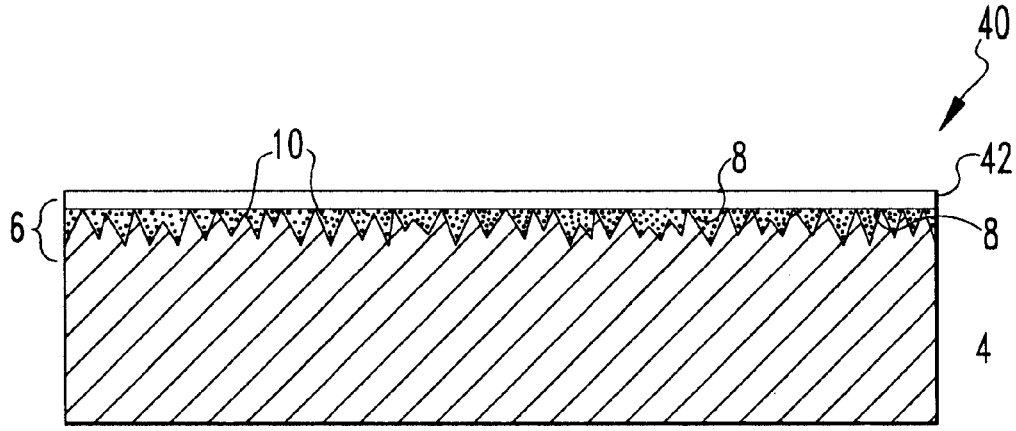
FIG. 4 is a cross-sectional view of a printing plate made in accordance with the present invention having a sealant layer.
Figure 5:
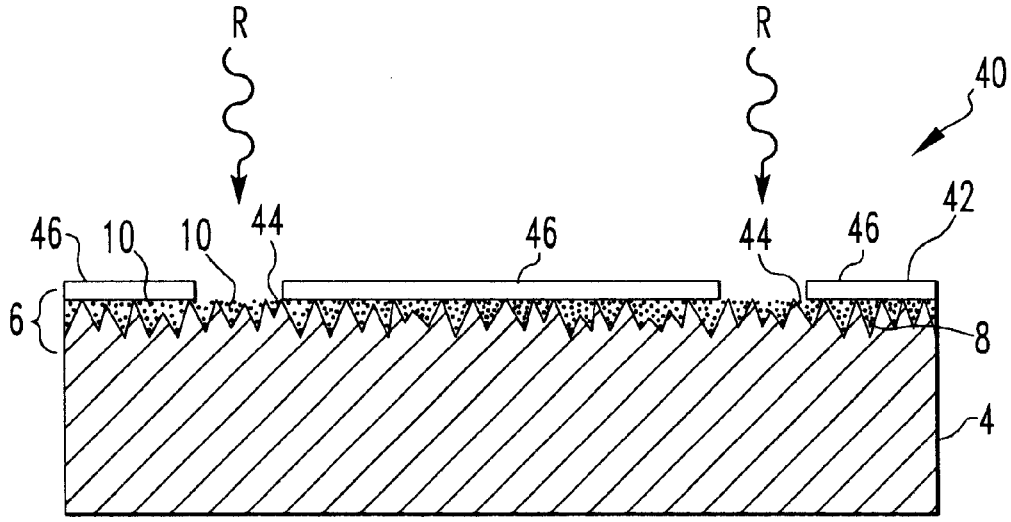
FIG. 5 is a cross-sectional view of the printing plate shown in FIG. 4 following radiation ablation of the sealant layer.

A second embodiment of the invention is shown in FIGS. 4 and 5. Printing plate 40 includes a sealant layer 42. The sealant layer 42 plugs the pores 10 and may be continuous or discontinuous over the principal surface portion 6. Suitable materials for the sealant layer are oleophobic and include nickel acetate, silicate, polyvinyl phosphonic acid and copolymers of acrylic acid and vinyl phosphonic acid. Preferably, the sealant layer 42 is applied to the principal surface portion in an immersion process. A pattern of imaging radiation R shown in FIG. 5 causes the sealant layer to ablate in regions 44 leaving unablated regions 46. The ablated regions 44 are oleophilic, while the unablated regions 46 are oleophobic. Ink of a printing liquid containing water or a fountain solution will adhere to the ablated regions 44 while the unablated regions 46 will be covered with water or a fountain solution.

Figure 6:
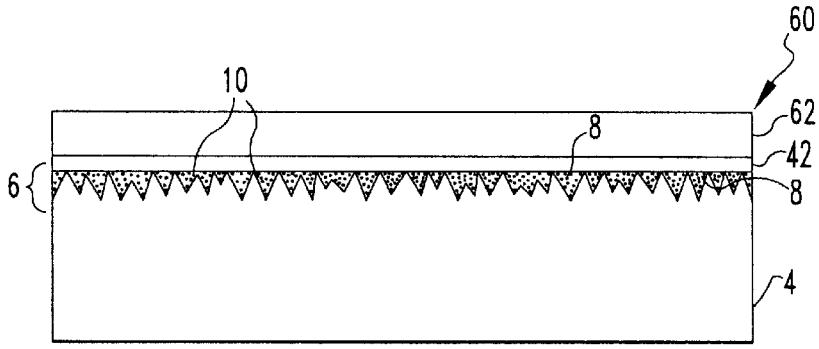
FIG. 6 is a cross-sectional view of a printing plate made in accordance with the present invention having a sealant layer covered with a coating composition.
Figure 7:
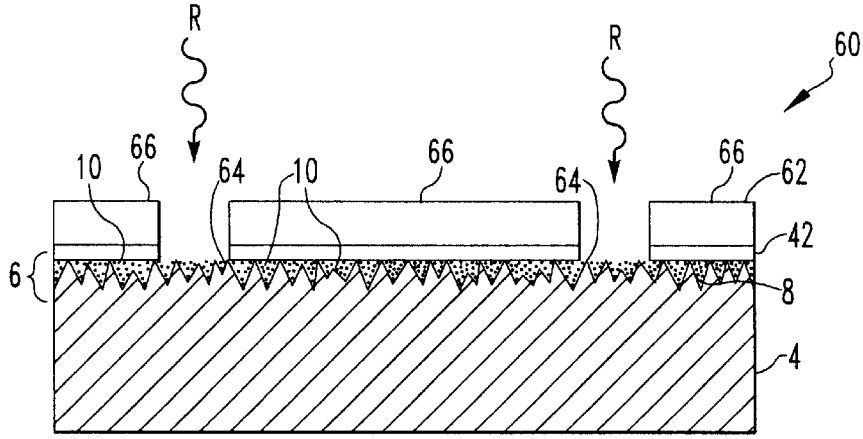
FIG. 7 is a cross-sectional view of the printing plate shown in FIG. 6 following radiation ablation of the sealant layer and coating composition.
Figure 8:
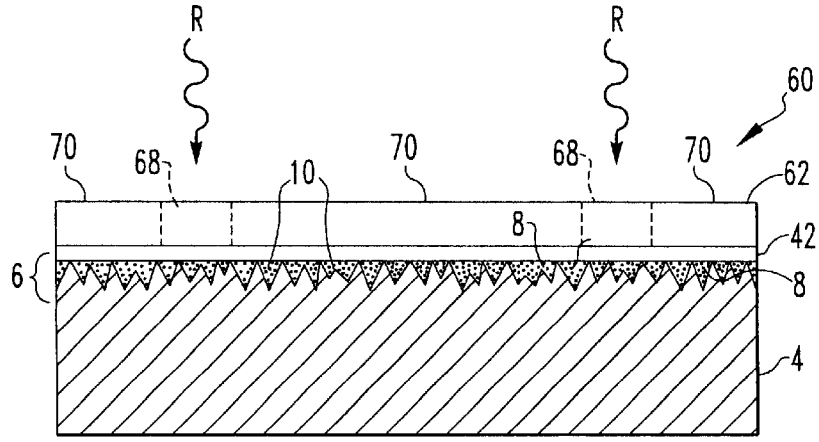
FIG. 8 is a cross-sectional view of the printing plate of FIG. 6 following radiation treatment of the coating composition to change the affinity of the coating composition for a printing liquid.

A third embodiment of the invention is shown in FIGS. 6–8. Printing plate 60 includes sealant layer 42 (as described above) and a coating composition 62. Coating composition 62 is similar to coating composition 12 of FIG. 3 and includes a hydrophilic polymer, e.g. a copolymer of vinyl phosphonic acid and acrylic acid cured at about 420° F. for about two minutes. In one aspect of the invention shown in FIG. 7, a pattern of imaging radiation R from a laser or the like causes the sealant layer 42 and the polymer coating composition 62 to ablate in regions 64 leaving unablated regions 66. Unablated regions 66 are hydrophilic while the ablated regions 64 are oleophilic.

Alternatively as shown in FIG. 8, radiation R causes regions 68 of the coating composition 62 to become oleophilic (without ablating the layer 62) while unexposed regions 70 remain hydrophilic. Ink of a printing liquid containing water or a fountain solution will adhere to the regions 68 while the regions 70 will be covered with water or a fountain solution. It is believed that when radiation is absorbed by the radiation-absorbing composition 10, heat is generated which is conducted to the regions 68 of the layer 62. Heating of the regions 68 is believed to change the surface chemistry of the polymer such that the affinity of the regions 68 to a printing liquid is altered.

It will be readily appreciated by those skilled in the art that modifications may be made to the invention without departing from the concepts disclosed in the foregoing description. Accordingly, the particular embodiments described in detail herein are illustrative only and are not limiting to the scope of the invention.

Having described the presently preferred embodiments, it is to be understood that the invention may be otherwise embodied within the scope of the appended claims.

We claim:

1. A printing plate comprising:

a metal substrate having an anodized surface portion, said surface portion defining a plurality of pores;

a radiation-absorbing composition received only in said pores; and a coating composition covering said surface portion and said radiation-absorbing composition.

2. The printing plate of claim 1, wherein said metal is an aluminum alloy.

3. The printing plate of claim 2, wherein said substrate is roll textured.

4. The printing plate of claim 3, wherein said substrate has a roughness of about 5 to about 45 microinches.

5. The printing plate of claim 1, wherein said radiation-absorbing composition is oleophilic.

6. The printing plate of claim 5, wherein said radiation-absorbing composition comprises a black dye.

7. The printing plate of claim 5, wherein said coating composition is hydrophilic.

8. The printing plate of claim 7, wherein said coating composition comprises an acrylic polymer.

9. The printing plate of claim 8, wherein said acrylic polymer comprises a copolymer of vinyl phosphonic acid and acrylic acid cured under conditions such that said copolymer is hydrophilic.

10. The printing plate of claim 1, wherein said radiation-absorbing composition is hydrophilic.

11. The printing plate of claim 10, wherein said radiation-absorbing composition comprises a black dye.

12. The printing plate of claim 10, wherein said coating composition is oleophilic.

13. The printing plate of claim 12, wherein said coating composition comprises a copolymer of vinyl phosphonic acid and acrylic acid cured under conditions such that said copolymer is oleophilic.

14. The printing plate of claim 13, further comprising a sealant composition disposed between said radiation-absorbing composition and said coating composition.

15. The printing plate of claim 14, wherein said sealant composition is selected from the group consisting of nickel acetate, silicate, and polyvinylphosphonic acid.

16. The printing plate of claim 14, wherein said coating composition and said sealant composition overlying said radiation-absorbing composition are ablatable by radiation directed thereto.

17. The printing plate of claim 14, wherein a first affinity for ink by said coating composition changes to a second affinity for ink when said coating composition overlying said radiation-absorbing composition is subjected to radiation.

18. The printing plate of claim 1, wherein said coating composition is ablatable by radiation directed onto said coating composition overlying said radiation-absorbing composition.

19. The printing plate of claim 1, wherein said coating composition overlying said radiation-absorbing composition has an affinity for ink, such that when said coating composition is subjected to radiation, said coating composition changes to have a different affinity for ink.

20. A method of imaging comprising the steps of:

providing a printing plate having a metal substrate with an anodized surface portion defining a plurality of pores, a radiation-absorbing composition received only in the pores, and a coating composition covering the surface portion with the radiation-absorbing composition; and exposing the printing plate to a pattern of imaging radiation until a first portion of the printing plate has an affinity for a printing fluid and a second portion of the printing plate has a different affinity for the printing fluid.

21. The method of claim 20 wherein said exposing step comprises ablating the coating composition in the location of the pattern of imaging radiation to reveal the anodized surface portion as the first portion of the printing plate, the coating composition not exposed to the radiation being the second portion of the printing plate.

22. The method of claim 20, wherein said exposing step comprises changing the affinity of the coating composition for a printing fluid in the location of the pattern of imaging radiation to the different affinity without ablating the coating composition.

23. The method of claim 20, wherein the radiation-absorbing composition is a black dye.

24. The method of claim 20, wherein the coating composition is an acrylic polymer.

* * * * *